US009296196B2

(12) United States Patent
Castagna et al.

(10) Patent No.: US 9,296,196 B2
(45) Date of Patent: Mar. 29, 2016

(54) PRINTING UNITS FOR VARIABLE-FORMAT OFFSET PRINTING PRESSES

(71) Applicant: OMET S.r.l., Lecco (IT)

(72) Inventors: Stefano Castagna, Civate (IT); Amerigo Manzini, Lecco (IT); Umberto Rostagno, Lecco (IT)

(73) Assignee: OMET S.r.l., Lecco (IT)

( * ) Notice: Subject to any disclaimer, the term of this patent is extended or adjusted under 35 U.S.C. 154(b) by 0 days.

(21) Appl. No.: 14/759,421

(22) PCT Filed: Jan. 15, 2014

(86) PCT No.: PCT/IB2014/058284

§ 371 (c)(1),
(2) Date: Jul. 7, 2015

(87) PCT Pub. No.: WO2014/111855

PCT Pub. Date: Jul. 24, 2014

(65) Prior Publication Data

US 2015/0336373 A1 Nov. 26, 2015

(30) Foreign Application Priority Data

Jan. 15, 2013 (IT) ..... TO2013A0033

(51) Int. Cl.

| | |
|---|---|
| ***B41F 13/44*** | (2006.01) |
| ***B41F 13/30*** | (2006.01) |
| ***B41F 13/32*** | (2006.01) |
| ***B41F 13/38*** | (2006.01) |

(52) U.S. Cl.

CPC ..... *B41F 13/44* (2013.01); *B41F 13/30* (2013.01); *B41F 13/32* (2013.01); *B41F 13/38* (2013.01)

(58) Field of Classification Search

CPC ..... B41F 13/30; B41F 13/32; B41F 13/38; B41F 13/40; B41F 13/44

See application file for complete search history.

(56) References Cited

U.S. PATENT DOCUMENTS

| | | | | |
|---|---|---|---|---|
| 2001/0035104 | A1* | 11/2001 | Gottling | B41F 13/34 101/248 |
| 2007/0039494 | A1* | 2/2007 | Chrigui | B41F 13/32 101/218 |
| 2009/0078135 | A1* | 3/2009 | Bangel | B41F 5/24 101/177 |

FOREIGN PATENT DOCUMENTS

| | | | |
|---|---|---|---|
| EP | 2042315 | A2 | 4/2009 |
| EP | 2103429 | A1 | 9/2009 |
| EP | 2388140 | A2 | 11/2011 |

* cited by examiner

*Primary Examiner* — Blake A Tankersley
(74) *Attorney, Agent, or Firm* — Robert E. Alderson, Jr.

(57) ABSTRACT

Variable-format offset printing units are provided in which each of the two supporting members of the intermediate cylinder is connected to the respective supporting member of the impression cylinder by a respective linear actuation device which includes a first element and a second element that are movable relative to each other along a direction of relative movement, wherein the first element of each linear actuation device is hinged to a respective supporting member of the intermediate cylinder and wherein the second element of each linear actuation device is hinged to a respective supporting member of the impression cylinder.

9 Claims, 6 Drawing Sheets

PRINTING UNITS FOR VARIABLE-FORMAT OFFSET PRINTING PRESSES

CROSS-REFERENCE TO RELATED APPLICATIONS

This application is a National Phase Application of PCT International Application No. PCT/IB2014/058284, International Filing Date, Jan. 15, 2014, claiming priority to Italian Patent Application No. TO2013A000033, filed Jan. 15, 2013 each of which is hereby incorporated by reference in its entirety.

FIELD OF THE INVENTION

The present invention relates to a printing unit intended to be used on so-called offset printing presses, and more specifically on variable-format offset printing presses.

BACKGROUND OF THE INVENTION

As is known, a variable-format offset printing unit comprises three rotating cylinders the axes of which are oriented horizontally. The first cylinder, usually referred to as plate cylinder, carries, wound around it, a printing plate designed to transfer by image areas the ink received by a number of inking rollers. The second cylinder, usually referred to as intermediate or transfer cylinder, is covered with elastomeric material, such as for example natural rubber, and is placed in contact with the plate cylinder. The third cylinder, usually referred to as impression cylinder, is placed in contact with the intermediate cylinder. The web of paper or of other material to be printed is fed between the intermediate cylinder and the impression cylinder. In use, the intermediate cylinder receives ink from the plate cylinder by image areas that make up the printed image and transfers the ink on the web that is being fed between the intermediate cylinder and the impression cylinder.

A pair of cylinders consisting in a plate cylinder and an intermediate cylinder having the same diameter is called print format. In order to change the print length it is necessary to change the diameter of the plate cylinder and of the intermediate cylinder and therefore also to change the distance between the axes of the three cylinders. The variable-format offset printing units are therefore provided, in a known manner, with mechanisms for adjusting the distance between the cylinders, which mechanisms allow, in case of change in the diameter of the cylinders, in particular of the plate cylinder and of the intermediate cylinder (which define the print format and affect the print length), to suitably change the distance between the cylinders so as to ensure contact between the intermediate cylinder and the plate cylinder on the one hand and between the intermediate cylinder and the impression cylinder on the other. Furthermore, in order to ensure that the printing process is carried out in the right way, a given contact pressure must be kept between the cylinders of the printing unit that are in contact with each other, namely both between the intermediate cylinder and the plate cylinder and between the intermediate cylinder and the impression cylinder.

Document EP-A-2388140, which discloses a variable-format offset printing unit having the features set forth in the preamble of the enclosed independent claim 1, suggests for this purpose to support the plate cylinder in a fixed position, to support each of the axially opposite ends of the intermediate cylinder (or of the impression cylinder) at the end of a respective tilting arm that is hinged at the opposite end so as to be able to tilt about a fixed tilting axis, and to support each of the axially opposite ends of the impression cylinder (or of the intermediate cylinder) along a respective linear guide. In this way, while the axis of the plate cylinder is fixed, the axis of the intermediate cylinder (or of the impression cylinder) is movable along a circular path having its centre positioned on the fixed tilting axis of the hinges of the tilting arms, while the axis of the impression cylinder (or of the intermediate cylinder) is movable along a straight path defined by the linear guides. The tilting movement of the tilting arms on which the supporting members of the intermediate cylinder (or of the impression cylinder) are mounted and the translational movement of the carriage(s) on which the supporting members of the impression cylinder (or of the intermediate cylinder) are mounted are driven by means of respective actuation devices. In case of change in the print format, and hence of replacement of the plate cylinder and of the intermediate cylinder, the tilting arm and the supporting member must be suitably moved by means of the respective actuation devices so as to bring the intermediate cylinder in contact with the plate cylinder and the impression cylinder in contact with the intermediate cylinder with the desired contact pressure. A disadvantage of this known solution is that any change in the position of the axis of the intermediate cylinder, due for example to the need to adjust the contact pressure against the plate cylinder, inevitably results in a change in the contact pressure between the intermediate cylinder and the impression cylinder and therefore forces the operator to intervene, by suitably controlling the actuation device associated to the impression cylinder, to restore the correct pressure between the intermediate cylinder and the impression cylinder.

SUMMARY OF THE INVENTION

It is therefore an object of the present invention to provide a variable-format offset printing unit that is not affected by the disadvantage of the prior art discussed above and that therefore allows to keep the correct contact pressure between the intermediate cylinder and the impression cylinder even if the position of the intermediate cylinder is changed.

This and other objects are fully achieved according to the present invention by virtue of variable-format offset printing units as described and claimed herein.

In short, the invention is based on the idea of providing a variable-format offset printing unit in which each of the two supporting members of the intermediate cylinder is connected to the respective supporting member of the impression cylinder by means of a respective linear actuation device comprising a first element and a second element that are movable relative to each other along a direction of relative movement, wherein the first element of each linear actuation device is hinged to a respective supporting member of the intermediate cylinder and wherein the second element of each linear actuation device is hinged to a respective supporting member of the impression cylinder. By virtue of the linear actuation devices being each coupled on the one hand with the axis of the intermediate cylinder and on the other with the axis of the impression cylinder, these devices allow to change the distance between the axes of the intermediate cylinder and of the impression cylinder, and hence to adjust the contact pressure between these cylinders. Once a given distance, and hence a given contact pressure, between the intermediate cylinder and the impression cylinder has been set, it remains unchanged even in case of changes in the position of the axis of the intermediate cylinder and/or of the axis of the impression cylinder, without requiring the operator to carry out the adjustment operation again.

Further features and advantages of the present invention will become clear from the following description, given purely by way of non-limiting examples with reference to the attached drawings.

DETAILED DESCRIPTION

Figure 1:
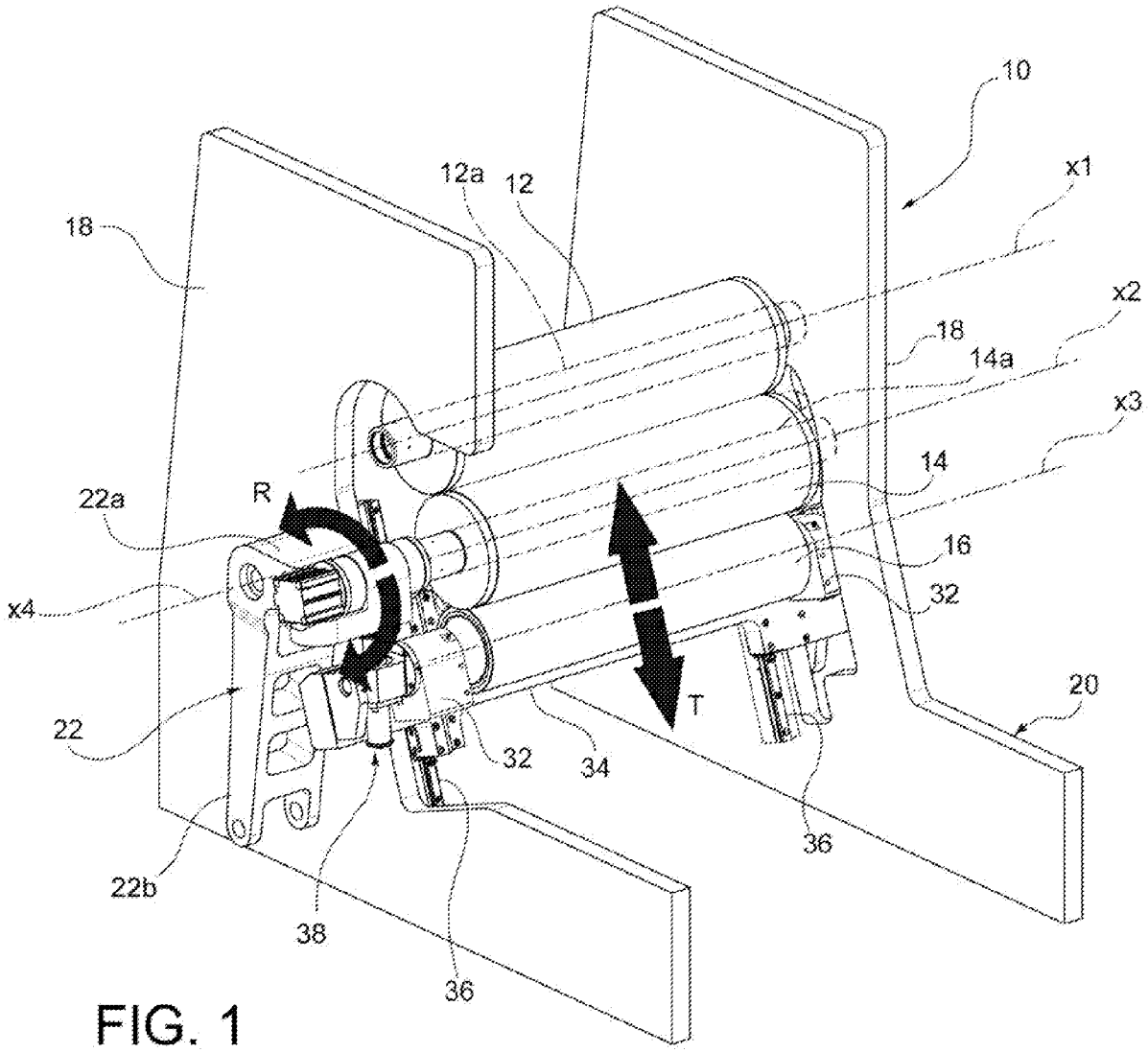
FIG. 1 is a perspective view of the cylinders (plate cylinder, intermediate cylinder and impression cylinder), along with their respective adjustment devices, of a printing unit for variable-format offset printing presses according to an embodiment of the present invention.
Figure 2:
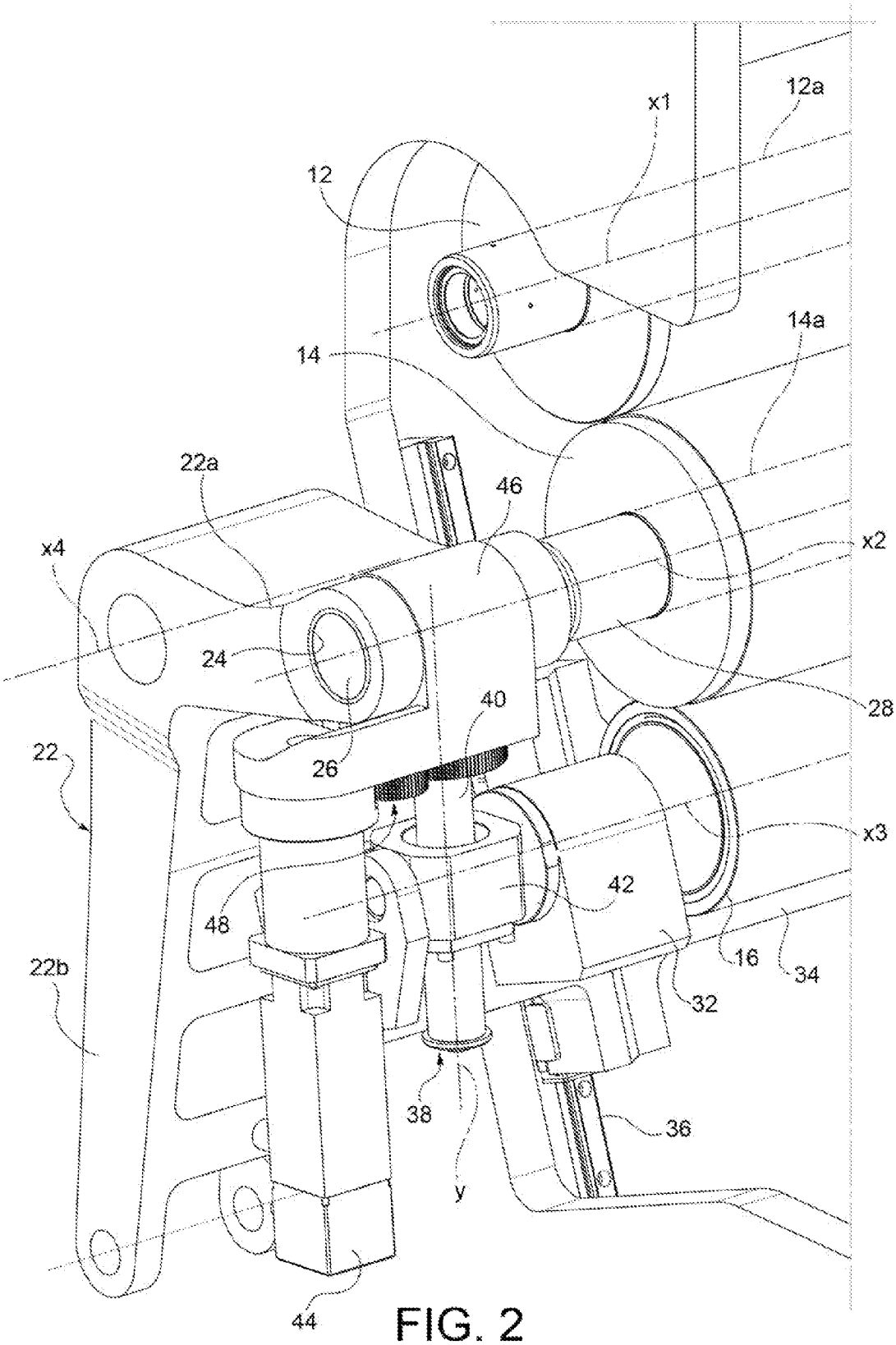
FIG. 2 is a perspective view showing on an enlarged scale one of the two sides of the printing unit of FIG. 1.

With reference to the drawings, reference numeral 10 generally indicates a printing unit intended to be used on variable-format offset printing presses (hereinafter simply referred to as printing unit), of which only the components that are of some importance for the present invention are shown.

The printing unit 10 comprises first of all three rotary cylinders, namely a plate cylinder 12, an intermediate cylinder 14 and an impression cylinder 16, the axes of which, indicated x1, x2 and x3, respectively, are oriented horizontally. In the proposed embodiment, the plate cylinder 12 and the intermediate cylinder 14, which form the print format and must therefore be replaceable with cylinders of different diameters, are configured as sleeves, that is to say, as hollow cylinders, and are fitted on respective middle support shafts 12*a* and 14*a*. In this way, when the print format has to be changed, it is sufficient to remove the plate cylinder and the intermediate cylinder from the respective middle support shafts and mount on those shafts a new plate cylinder and a new intermediate cylinder having the desired diameters. The plate cylinder and the intermediate cylinder might though be of a different type, for example be deprived of a middle support shaft and be provided with end support hubs.

The plate cylinder 12 (with the respective middle support shaft 12*a*, if any) is supported for rotation about its axis x1 by means of a pair of supporting members (not shown) mounted on a pair of side vertical walls, or shoulders, 18 of a support structure 20 of the printing unit 10. The supporting members of the plate cylinder 12 are preferably made as eccentric supporting members, so as to allow, if necessary, to move that cylinder away from the intermediate cylinder 14.

The intermediate cylinder 14 (with the respective middle support shaft 14*a*, if any) and the impression cylinder 16 are supported at their axially opposite ends by means of respective supporting members, the position of which is adjustable by means of respective adjustment devices, described in detail further on, to enable to change both the distance between the axis x1 of the plate cylinder 12 and the axis x2 of the intermediate cylinder 14, and the distance between the axis x2 of the intermediate cylinder 14 and the axis x3 of the impression cylinder 16 when the plate cylinder 12 and the intermediate cylinder 14 have to be replaced by cylinders of different diameter to change the print format. The supporting members of the intermediate cylinder 14 and of the impression cylinder 16 and their respective adjustment devices on the two sides of the printing unit 10 are substantially equal to each other. The following description will therefore refer to one of the two sides of the printing unit only, and what will be described in connection with that side is of course to be regarded as being equally applicable to the other side of the printing unit.

Figure 5A:
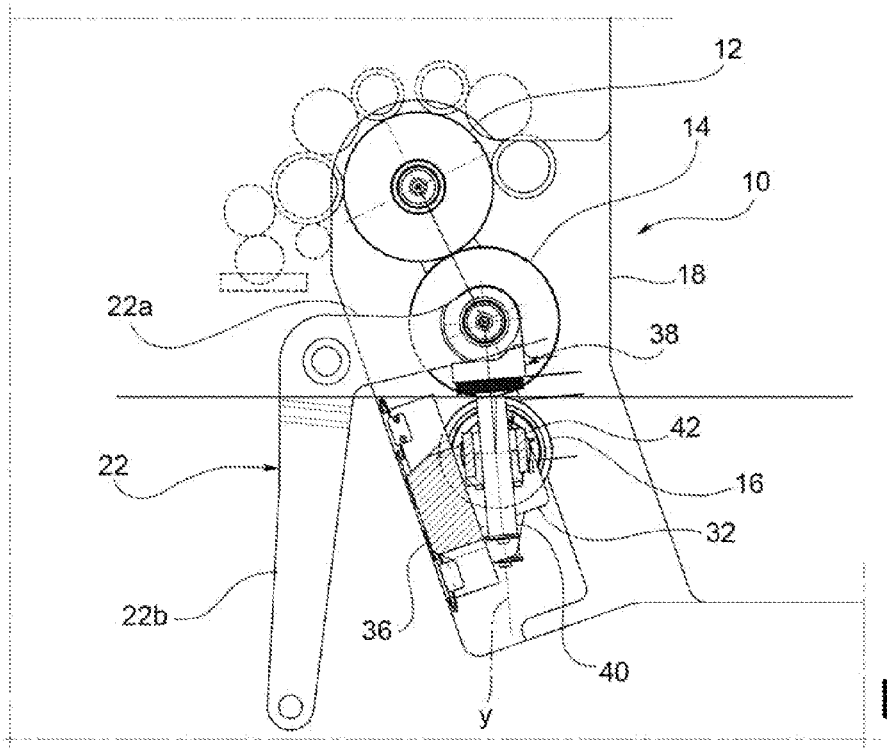
FIGS. 5A and 5B are side views showing schematically the printing unit of FIG. 1 in the operating condition for large print formats and in the operating condition for small print formats, respectively.
Figure 5B:
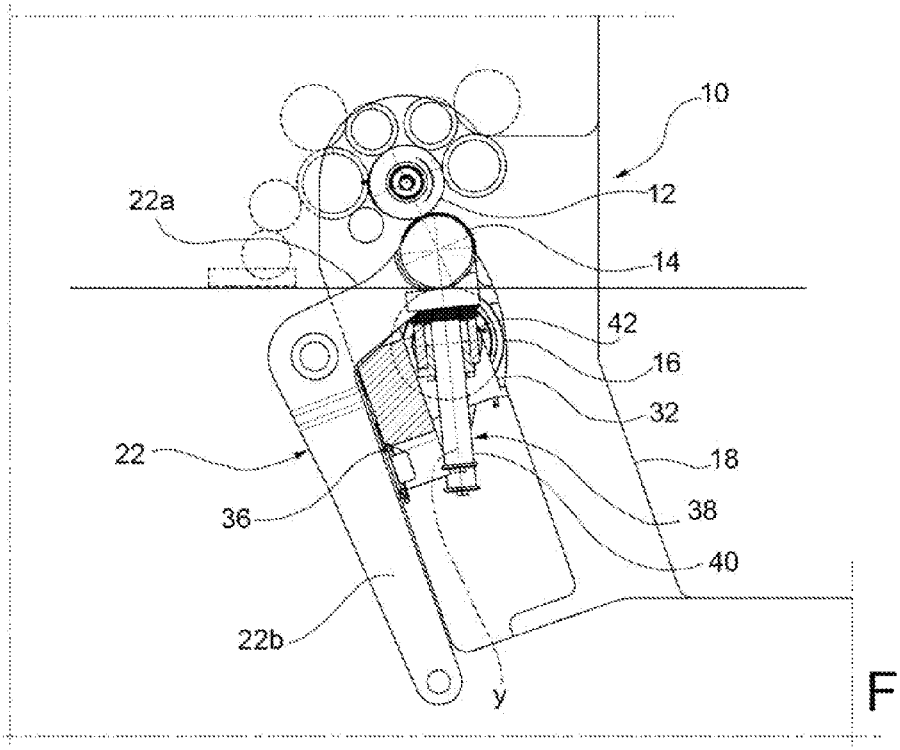
Figure 6:
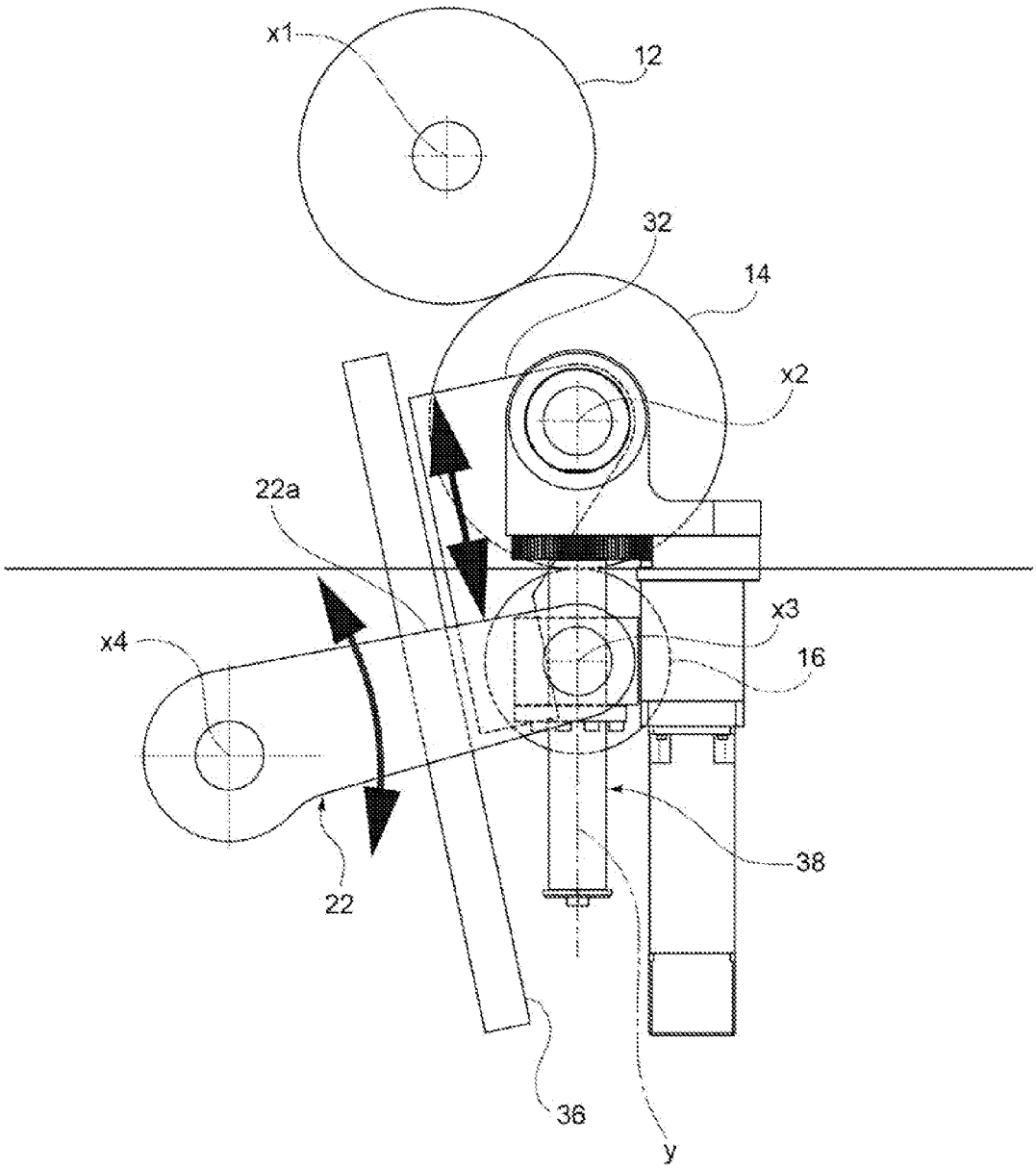
FIG. 6 is a side elevation view of the cylinders and of their respective adjustment devices of a variable-format offset printing unit according to a further embodiment of the present invention.

More specifically, according to the present invention the intermediate cylinder 14 and the impression cylinder 16 are supported in such a manner that the axis of one of the two cylinders (axis x2 of the intermediate cylinder 14 in the embodiment shown in FIGS. 1 to 5B, and axis x3 of the impression cylinder 16 in the embodiment shown in FIG. 6) is movable along a circular path having a fixed centre (wherein the term "fixed" is to be intended with respect to the support structure 20 of the printing unit 10), while the axis of the other cylinder (axis x3 of the impression cylinder 16 in the embodiment shown in FIGS. 1 to 5B, and axis x2 of the intermediate cylinder 14 in the embodiment shown in FIG. 6) is movable along a straight path.

Figure 3:
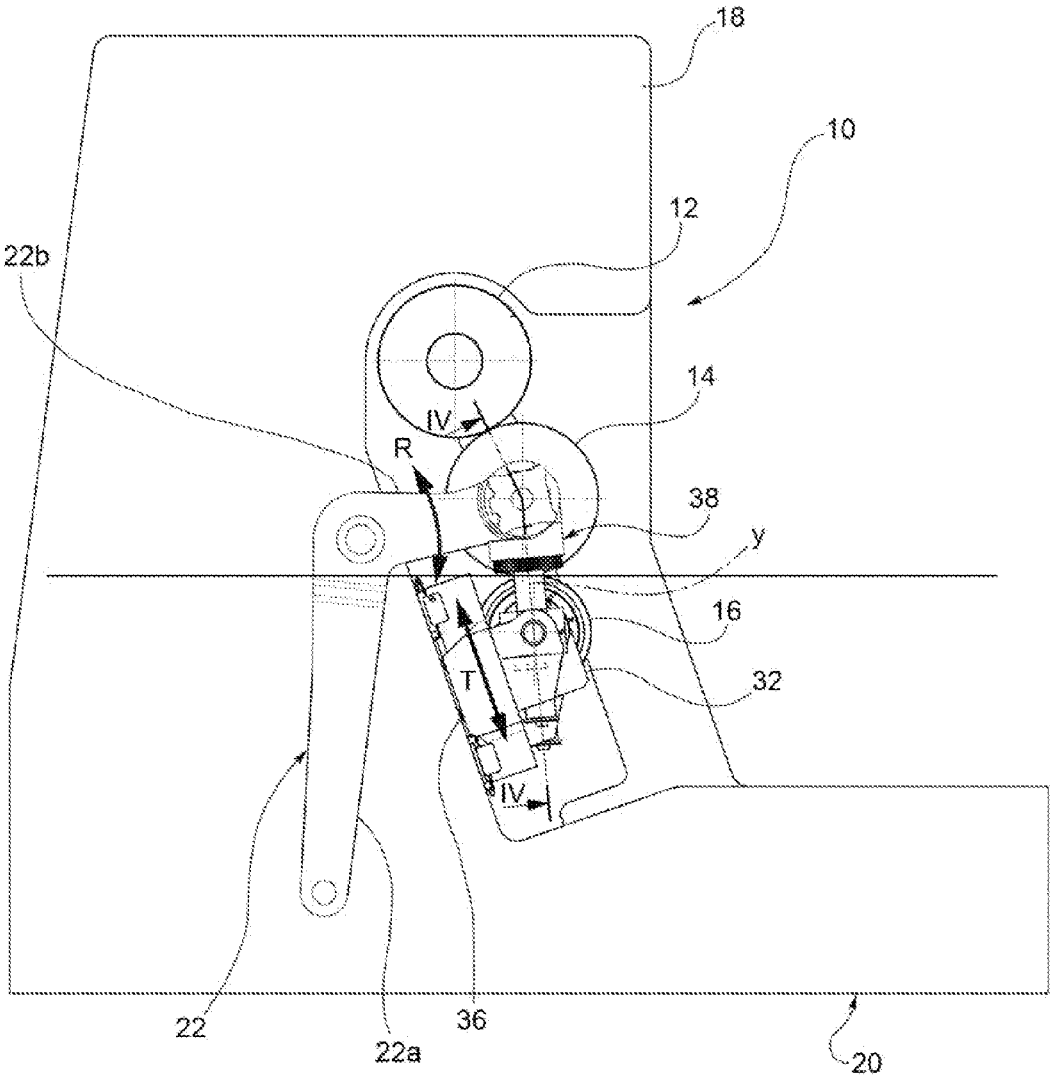
FIG. 3 is a side elevation view of the printing unit of FIG. 1.
Figure 4:
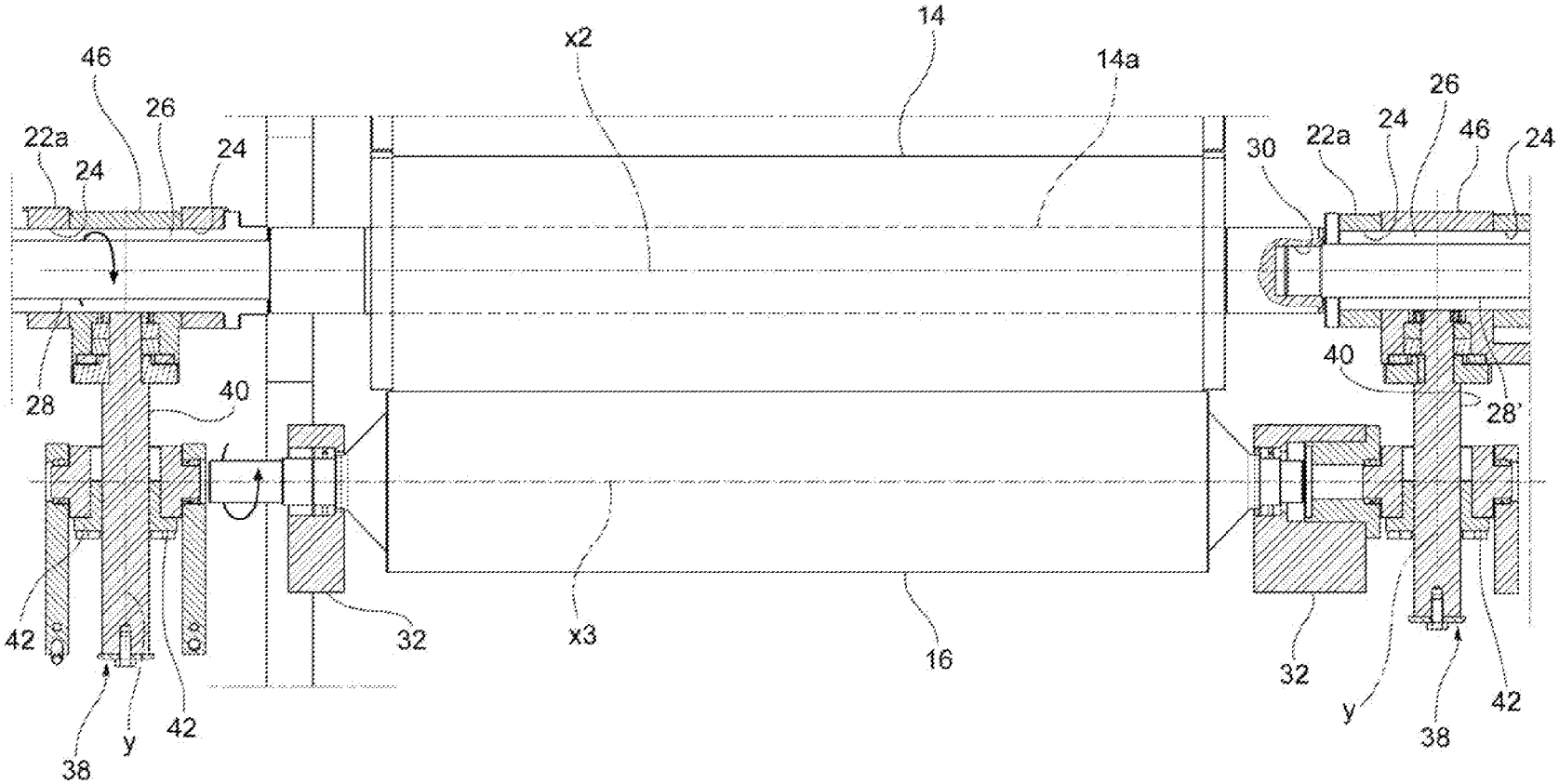
FIG. 4 is a section view of the printing unit of FIG. 1 through the section line IV-IV.

With reference now to the embodiment shown in FIGS. 1 to 5B, the intermediate cylinder 14 is supported on a tilting lever 22 hinged to the support structure 20 so as to be able to tilt in either direction about a fixed tilting axis x4, as indicated by double arrow R in FIGS. 1 and 3. The axis x2 of the intermediate cylinder 14 is therefore movable along a circular path having its centre on the tilting axis x4. Such a movement allows to adjust the distance between the axes of the plate cylinder 12 and of the intermediate cylinder 14.

According to the embodiment shown in FIGS. 1 to 5B, the tilting lever 22 is a bell crank, with a first arm 22*a* and a second arm 22*b* forming a given angle, for example an angle of about 90 degrees, and is hinged in the region where the two arms 22*a* and 22*b* are joined to each other. According to this embodiment, the intermediate cylinder 14 is supported at the free end of the arm 22*a* of the tilting lever 22, while an end of a linear actuation device (not shown), for example an electrically-, hydraulically- or pneumatically-operated linear actuation device, for causing the tilting lever 22 to tilt about the tilting axis x4 is designed to be hinged to the free end of the other arm 22*b*.

According to the embodiment shown in FIGS. 1 to 5B, the free end portion of the arm 22*a* of the tilting lever 22 has a fork-like shape and has a pair of coaxial through holes 24 (FIGS. 2 and 4), in which a support sleeve 26 is coaxially mounted. Respective end support shafts 28 and 28', through which the middle support shaft 14*a* is supported at its opposite ends by the support sleeves 26, extend coaxially inside the support sleeves 26 on the two sides of the printing unit 10. More specifically, in the illustrated embodiment the end support shaft 28 (left-hand shaft, according to the point of view of a person looking at FIG. 4) is integrally formed by the middle support shaft 14*a*, and has a smaller diameter than this latter, or is at least drivingly connected for rotation with that shaft, while the end support shaft 28' (right-hand shaft, according to the point of view of a person looking at FIG. 4) is made as a separate piece from the middle support shaft 14*a* and engages in an axial cavity 30 provided in this latter. Both the end support shafts 28 and 28' and the support sleeves 26 are arranged coaxially with the middle support shaft 14*a*, and hence their axes coincide with the axis x2 of the intermediate cylinder 14. In this way, when the tilting lever 22 tilts about the tilting axis x4, the axis x2 of the intermediate cylinder 14 moves along a circular path having its centre on the tilting axis x4.

The intermediate cylinder 14 is driven to rotate about its axis x2 by means of a motor (not shown). According to an embodiment, the motor is fixed to the free end portion of the arm 22*a* of the fork 22 and is torsionally coupled to one of the two end support shafts, namely to the end support shaft 28 that is integrally formed by the middle support shaft 14*a* or is at least drivingly connected for rotation with that shaft.

Still with reference to the embodiment shown in FIGS. 1 to 5B, the impression cylinder 16 is supported at its opposite ends by means of a pair of supporting members 32 fixed to a carriage 34. The carriage 34 is slidably mounted along a straight direction, as indicated by double arrow T in FIGS. 1 and 3, by means of a pair of linear guides 36 fixed to the support structure 20. The axis x3 of the impression cylinder 16 is therefore movable along a straight path, that in the illustrated embodiment is inclined by a given angle, in particular an angle less than 45 degrees, to the vertical direction. Even though in the illustrated embodiment the two supporting members 32 are fixed to a common element, namely the carriage 34, they might also be completely independent of each other.

In order to allow to adjust the distance between the axes of the intermediate cylinder 14 and of the impression cylinder 16, the printing unit 10 comprises, on each of its two sides, a respective linear actuation device 38 comprising a first element 40 and a second element 42 that are movable relative to each other along a direction of relative movement y, wherein the first element 40 is hinged to a respective supporting member of the intermediate cylinder 14, preferably, although not necessarily, about the axis x2 of that cylinder, and the second element 42 is hinged to a respective supporting member of the impression cylinder 16, preferably, although not necessarily, about the axis x3 of that cylinder. The linear actuation device 38 is therefore coupled on the one hand to the intermediate cylinder 14, and hence to the axis x2 thereof, and on the other to the impression cylinder 16, and hence to the axis x3 thereof. Accordingly, the linear actuation device 38 allows to change the distance between the axes x2 and x3, and therefore to adjust the contact pressure between the intermediate cylinder 14 and the impression cylinder 16. Moreover, once a given distance has been set, and therefore a given contact pressure has been established, between the intermediate cylinder 14 and the impression cylinder 16, the linear actuation device 38 ensures that said distance, and hence said contact pressure, remain unchanged even in case of changes in the position of the axis x2 of the intermediate cylinder 14 and/or of the axis x3 of the impression cylinder 16, with no need for the operator to perform the adjustment operation again.

The linear actuation device 38 may be of various kinds. For example, in the embodiment shown in FIGS. 1 to 5B, the linear actuation device 38 is a screw and nut device driven by an electric motor 44. The first element 40 consists in that case in a screw supported by a body 46 for rotation about its own axis (coinciding with the direction y). The axis of the screw 40 extends perpendicular to the axis x2 of the intermediate cylinder 14 and to the axis x3 of the impression cylinder 16 and intersects both these axes. The body 46 is hinged to the free end of the arm 22*a* of the tilting lever 22 so to rotate with respect to this latter about the axis x2 of the intermediate cylinder 14. In the illustrated embodiment, the body 46 is received between the two prongs of the fork-like free end portion of the arm 22*a* of the tilting lever 22 and has a through hole through which the support sleeve 26 extends, whereby the body 46 is able to rotate relative to the support sleeve 26 about the axis x2. As far as the second element 42 is concerned, it consists in this case in a nut that is hinged to the supporting member 32 so as to rotate relative to this latter about the axis x3 of the impression cylinder 16. The arrangement of the screw and of the nut might also be reversed, in that the screw 40 might be associated to the impression cylinder 16 and the nut 42 to the intermediate cylinder 14. In the illustrated embodiment, the electric motor 44 is carried by the body 46 with its axis parallel to the axis of the screw 40 and controls rotation of the screw by means of a gearing that is generally indicated 48.

FIGS. 5A and 5B show the printing unit 10 in two different operating conditions, that is to say, an operating condition for large print formats and an operating condition for small print formats, respectively. The reduction in the distance between the axes of the plate cylinder 12 and of the intermediate cylinder 14 when shifting from large print format to small print format is obtained by causing the tilting lever 22 to tilt (in the clockwise direction, according to the point of view of a person looking at these Figures) about its axis x4, while the reduction in the distance between the axes of the intermediate cylinder 14 and of the impression cylinder 16 when shifting from large print format to small print format is obtained by causing the carriage 34, and hence the supporting members 32 therewith, to slide upwards along the linear guides 36 by means of the linear actuation devices 38. Once the desired distance between the axes of the intermediate cylinder 14 and of the impression cylinder 16 has been set, and hence the desired contact pressure between these cylinders has also been set, in other words once the relative position of the two elements 40 and 42 of each of the two linear actuation devices 38 has been set, the contact pressure between these cylinders remains unchanged until the relative position of the two elements 40 and 42 of each of the two linear actuation devices 38 is changed.

Finally, FIG. 6, where parts and elements identical or corresponding to those of the preceding Figures have been given the same reference numerals, shows a variant of embodiment of the printing unit 10 that differs from the one described above with reference to FIGS. 1 to 5B substantially in that the adjustment devices associated to the intermediate cylinder 14 and to the impression cylinder 16 are inverted. In this case, in fact, the intermediate cylinder 14 is supported (by means of the supporting members 32 slidable along the linear guides 36) in such a manner that its axis x2 is movable along a straight path, while the impression cylinder 16 is supported (by means of the tilting levers 22) in such a manner that its axis x3 is movable along a circular path. Moreover, in the embodiment of FIG. 6 a motor or other actuation device will be provided to control the sliding movement of the supporting members 32 along the linear guides 36, while the tilting levers 22 will be free to tilt about the respective tilting axes x4.

Naturally, the principle of the invention remaining unchanged, the embodiments and the constructional details may vary widely from those described and illustrated purely by way of non-limiting example.

The invention claimed is:

1. A printing unit for variable-format offset printing presses, comprising a support structure, a plate cylinder supported by the support structure for rotation about a first axis, an intermediate cylinder supported for rotation about a second axis parallel to the first axis, and an impression cylinder supported for rotation about a third axis parallel to the first axis and to the second axis, wherein the intermediate cylinder or the impression cylinder is supported at its axially opposite ends by respective supporting members each carried by a respective tilting lever supported by the support structure so as to tilt about a fixed tilting axis parallel to the first, second and third axes, whereby the second axis or the third axis, respectively, is movable along a circular path with a fixed centre on the tilting axis, wherein the impression cylinder or the intermediate cylinder, respectively, is supported at its axially opposite ends by means of respective supporting members slidable along respective linear guides carried by the support structure, whereby the third axis or the second axis, respectively, is movable along a straight path, and wherein each of the supporting members of the intermediate cylinder is connected to a respective supporting member of the impression cylinder by a respective linear actuation device comprising a first element and a second element movable relative to each other along a direction of relative movement (y), the first element being hinged to a respective supporting member of the intermediate cylinder and the second element being hinged to a respective supporting member of the impression cylinder.

2. The printing unit of claim 1, wherein the first element of each linear actuation device is hinged to a respective supporting member of the intermediate cylinder about the second axis.

3. The printing unit of claim 1, wherein the second element of each linear actuation device is hinged to a respective supporting member of the impression cylinder about the third axis.

4. The printing unit of claim 1, wherein the direction of relative movement (y) of the first element and of the second element of each linear actuation device extends perpendicular to the second and third axes and intersects both of these axes.

5. The printing unit of claim 1, wherein each linear actuation device comprises a screw and nut device.

6. The printing unit of claim 5, wherein the screw and the nut of the screw and nut device form the first and second elements, respectively, of each linear actuation device.

7. The printing unit of claim 1, wherein each tilting lever comprises a fork-like free end portion having a pair of coaxial through holes where an end support shaft connected for rotation with the intermediate cylinder, or with the impression cylinder, is rotatably supported.

8. The printing unit of claim 7, wherein the screw of each linear actuation device is supported for rotation about its own axis by a body that is received between two prongs of the fork-like free end portion of the respective tilting lever and has a through hole through which the respective end support shaft extends.

9. The printing unit of claim 8, wherein each linear actuation device further comprises motor elements carried by the body and adapted to generate a rotary motion, and motion transmission elements adapted to transmit to the screw the rotary motion generated by said motor elements.

* * * * *